US008377351B2

(12) United States Patent
Lefevre et al.

(10) Patent No.: US 8,377,351 B2
(45) Date of Patent: Feb. 19, 2013

(54) POLISHING PAD WITH CONTROLLED VOID FORMATION

(75) Inventors: Paul Lefevre, Topsfield, MA (US); David Adam Wells, Hudson, NH (US); Marc C. Jin, Boston, MA (US); Oscar K. Hsu, Chelmsford, MA (US); John Erik Aldeborgh, Boxford, MA (US); Scott Xin Qiao, Macungie, PA (US); Anoop Mathew, Peabody, MA (US); Guangwei Wu, Sunnyvale, CA (US)

(73) Assignee: Innopad, Inc., Wilmington, MA (US)

( * ) Notice: Subject to any disclaimer, the term of this patent is extended or adjusted under 35 U.S.C. 154(b) by 0 days.

(21) Appl. No.: 12/244,513

(22) Filed: Oct. 2, 2008

(65) Prior Publication Data

US 2009/0246504 A1 Oct. 1, 2009

Related U.S. Application Data

(60) Provisional application No. 61/041,422, filed on Apr. 1, 2008.

(51) Int. Cl.
*B29C 44/34* (2006.01)

(52) U.S. Cl. ..... 264/51

(58) Field of Classification Search ..... 264/51; 521/155

See application file for complete search history.

(56) References Cited

U.S. PATENT DOCUMENTS

| | | | | |
|---|---|---|---|---|
| 5,578,362 | A | 11/1996 | Reinhardt | |
| 6,656,018 | B1 | 12/2003 | Hsu et al. | |
| 6,899,611 | B2 | 5/2005 | Reinhardt | |
| 2002/0077037 | A1 * | 6/2002 | Tietz | 451/41 |
| 2003/0168627 | A1 | 9/2003 | Singh et al. | |
| 2005/0222288 | A1 * | 10/2005 | Seyanagi et al. | 521/155 |
| 2006/0116059 | A1 * | 6/2006 | Chen et al. | 451/532 |
| 2006/0189269 | A1 | 8/2006 | Roy et al. | |

FOREIGN PATENT DOCUMENTS

WO WO 2008/011535 * 1/2008

OTHER PUBLICATIONS

International Search Report and Written Opinion dated Dec. 5, 2008 issued in related International Patent Application No. PCT/US0878610.

* cited by examiner

*Primary Examiner* — Larry Thrower

(74) *Attorney, Agent, or Firm* — Grossman, Tucker, Perreault & Pfleger, PLLC

(57) ABSTRACT

A chemical-mechanical planarization polishing pad is provided comprising a network of elements dispersed within a polymer, a plurality of voids formed in the pad and at least a portion of said network of elements is connected to at least a portion of the voids. A method of forming the pad is also disclosed, which comprises providing a composition, the composition comprising a network of elements and at least one of a polymer or a reactive prepolymer, introducing a gas to the composition and using the gas to produce a plurality of voids in the composition. A method of forming voids is also disclosed, which relies upon the application of a force to the network of elements within the polymer or reactive polymer, followed by removal of the force and void formation.

16 Claims, 8 Drawing Sheets

FIG. 4

Effect Of Water Content On Void Content

| Water Content in Urethane % | Surfactant %* | Pad Density, g/cc | Void Content, %** |
|---|---|---|---|
| 0.5 | 0.1 | 0.97 | 15.65 |
| 0.5 | 0.1 | 0.95 | 17.39 |
| | | | |
| 1 | 0.2 | 0.78 | 32.17 |
| 1 | 0.2 | 0.75 | 34.78 |
| | | | |
| Density of solid, non-porous pad = 1.15 g/cc | | | |
| Fabric composition: Polyacrylate nonwoven stacked on Polyester nonwoven | | | |
| Fabric weights: 984 + 36 - 68 grams | | | |
| * % of water content in urethane | | | |
| ** % Void Content = 100* (1.15-pad density)/1.15 | | | |

FIG. 5

Effect Of Pre-Heating Fabric On Void Content

| Water Content in Urethane % | Surfactant %* | Pad Density, g/cc | Void Content, %** |
|---|---|---|---|
| 0.5 | 0.2 | 1.03 | 10.43 |
| 0.5 | 0.2 | 1.01 | 12.17 |
| | | | |
| 1 | 0.2 | 0.85 | 26.09 |
| 1 | 0.2 | 0.87 | 24.35 |

Pre-heat fabric in oven for 30 min. at 212 deg F

Fabric Composition: Polyacrylate nonwoven stacked on Polyester nonwoven

Fabric weights: 984 + 36 - 68 grams

* % of water content in urethane

** % Void Content = 100* (1.15-pad density)/1.15

FIG. 6

Effect Of Gap Height (Within Mold) On Void Content

| Gap Height, mils | Pad Density, g/cc | Void Content, %** |
|---|---|---|
| 130 | 1.05 | 8.7 |
| 100 | 0.81 | 29.57 |
| | | |
| Fabric composition: 100% Polyester nonwoven | | |
| % of water content in urethane = 0 | | |
| % of surfactant on water content = 0 | | |
| ** % Void Content = 100* (1.15-pad density)/1.15 | | |

130 Mils Gap Height (Within Mold) Showing Void Content

100 Mils Gap Height (Within Mold) Showing Void Content

POLISHING PAD WITH CONTROLLED VOID FORMATION

CROSS-REFERENCE TO RELATED APPLICATIONS

This application claims the benefit of U.S. Provisional Patent Application Ser. No. 61/041,422, filed on Apr. 1, 2008, which is fully incorporated herein by reference.

FIELD OF THE INVENTION

The present invention relates to a chemical/mechanical polishing pad for use in polishing materials, such as in semiconductor devices formed from a relatively flat or thin semiconductor material, such as silicon. The polishing pad may include a fibrous polymer matrix containing/voids, where the void geometry, distribution, size, etc., is regulated to targeted levels by manufacturing protocols.

BACKGROUND

In applying CMP (Chemical Mechanical Planarization) as a process step in the manufacture of micro-electronic devices such as semiconductor wafers, blanket silicone wafers and computer hard disks, a polishing pad may be used in conjunction with an abrasive-containing or abrasive-free slurry to affect planarization of the surface of the device. To achieve a high degree of planarity of the surface of the device, typically measured in the order of Angstoms, the slurry flow should be distributed uniformly between the surface of the device and the pad. To facilitate such uniform distribution of the slurry, a plurality of grooves or indentation structure may be provided on a polishing pad. The plurality of grooves may have individual groove widths of 0.010 inches to 0.050 inches, depths of 0.010 inches to 0.080 inches and distance between adjacent grooves of 0.12 inches to 0.25 inches, respectively.

While the grooves may provide the above-mentioned benefits, nevertheless, they may not be sufficient to effect local planarization on the die (or single microchip) level on a semiconductor wafer. This may be due to the relatively large differences between the grooves and the individual features, such as interconnects, on the microchip. Advanced ULSI and VLSI microchips, for example, may have feature sizes on the order of 0.35 micrometers (0.000014 inches) that are many times smaller than the width and depths of the individual grooves on the polishing pad. In addition, the feature sizes on a microchip are also thousands of times smaller than the distance between the adjacent grooves, which may result in non-uniform distribution of the slurry on a feature size level.

In an effort to improve upon the uniformity of local, feature-scale planarization, CMP pad manufacturers have, in some instances, provided asperities or high and low areas on the surface of the pads. These asperities may have a size ranged from 20 to over 100 micrometers. While, such asperities may be closer in size to that of the microchip features, as compared to the grooves, the asperities may change in shape and size during the polishing process, and may require continuous regeneration by abrading the polishing pad surface with a conditioner fitted with diamond abrasive particles. The diamond abrasive particles on the conditioner continuously scrape off the surface asperities that are deformed as a result of frictional contact between the pad, the slurry and the surface of the device, and expose new asperities to maintain consistency of planarization. The conditioning process, however, may be unstable, as it may utilize the sharp diamond particles to sever the deformed asperities. The severance of the deformed asperities may not be well controlled, resulting in changes in the size, shape and distribution of the asperities that in turn may cause variation in the uniformity of planarization. Furthermore, the frictional heat generated from conditioning may also contribute to the non-uniformity of planarization, by changing the surface properties of the pad, including properties such as shear modulus, hardness and compressibility.

SUMMARY

A first method of forming a chemical-mechanical planarization polishing pad is provided comprising providing a composition, the composition comprising a network of elements and at least one of a polymer and a reactive prepolymer. One may then introduce a gas to the composition and utilize the gas to produce a plurality of voids in the composition.

A second method of forming a chemical-mechanical planarization polishing pad is provided comprising providing a composition, the composition including a network of elements and at least one of a polymer and a reactive polymer. The network of elements has a dimension of length, width and/or thickness, and one of said length, width or thickness dimension is changed by the application of a force in the presence of one of the polymer or reactive prepolymer. When the force is removed at least one of said length, width or thickness dimension then changes in value which then leads to the formation of one or a plurality of voids. The second method may be used alone and/or in conjunction with the first method. One may also use a combination of a polymer with a reactive prepolymer.

A chemical-mechanical planarization polishing pad is also provided comprising a network of elements dispersed within a polymer, a plurality of voids formed in the pad and at least a portion of said network of elements is connected to at least a portion of the voids.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein:

FIG. 4 is a table showing the effect of water content on void content;

FIG. 5 is a table showing the effect of pre-heating fabric on void content;

FIG. 6 is a table showing the effect of gap height within the mold on void content;

DETAILED DESCRIPTION

Figure 1:
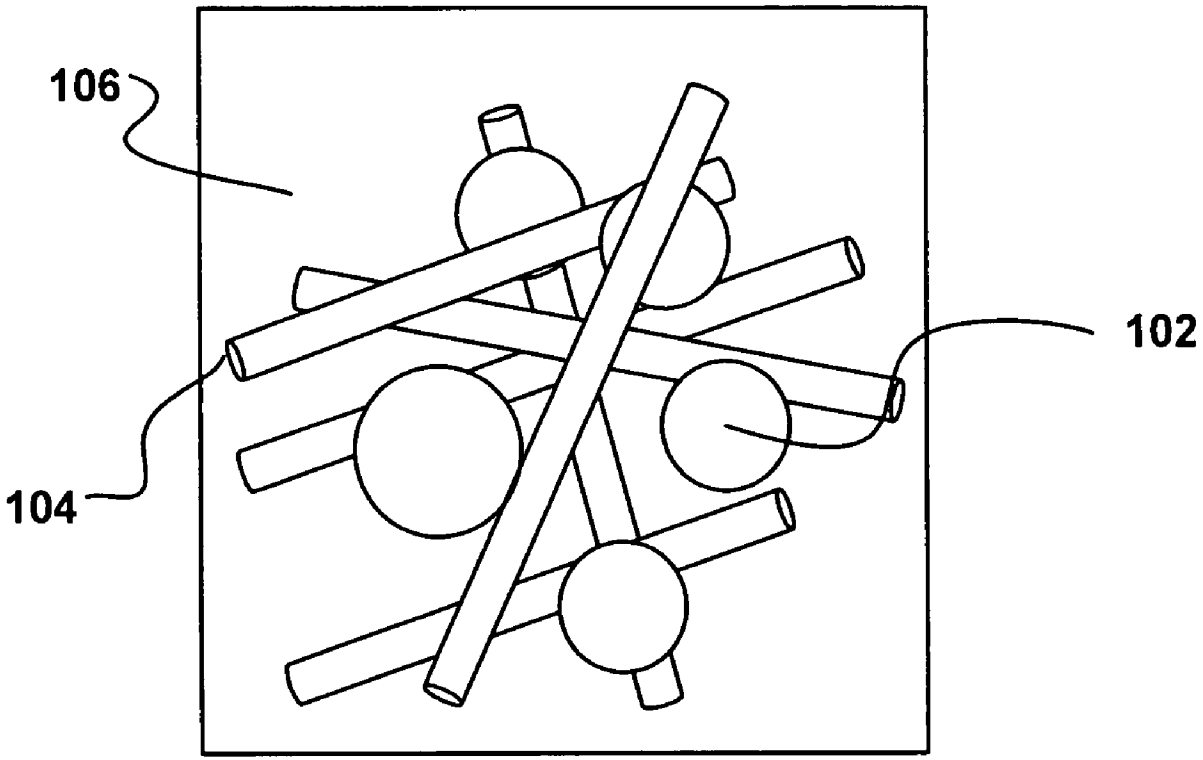
FIG. 1 is an example of voids in a polymer matrix.

It may be appreciated that the present disclosure is not limited in its application to the details of construction and the arrangement of components set forth in the following description or illustrated in the drawings. The embodiments herein may be capable of other embodiments and of being practiced or of being carried out in various ways. Also, it may be appreciated that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure relates to chemical mechanical planarization polishing pads which may be used in the process of polishing or planarizing a substrate, such as a silion wafer. The polishing pad matrix may include thermoplastic or thermoset polymers, including polyurethane, polycarbonate, polysulfone, polyphenylene sulfide, epoxy, various polyesters, polyimides, polyamides, polyolefins, polyacrylates, polymethylmethacrylates, polyvinyl chlorides, polyvinyl alcohols and/or derivatives of or copolymers of the above. In one example, the polishing pad matrix (i.e. the volume defined by a given pad) may include a polyurethane prepolymer and a curing agent, supplied to crosslink and/or polymerize the urethane pre-polymer.

The polishing pad may include a number of elements, such as a network of interconnecting and/or non-interconnecting elements dispersed within the polymer. The elements may be formed of fibers. The fibers may be soluble (e.g. in a slurry used with the pad when the pad is used for polishing, such as an aqueous slurry), insoluble or a mixture thereof. In addition, the fibers may have a length in the range of 0.1 mm to 500 mm, including all values and increments therein and a diameter in the range of 0.1 μm to 100 μm, including all values and increments therein. The network may be provided as a fabric. The fabric may be a woven or non-woven fabric. Non-woven fabrics may include, for example carded, spunbond, or melt blown fabrics. Such fabrics are typically provided in a sheet form, which may be characterized as an expanse of flat (planar) material (e.g. being thin relative to length and width) which is generally manufactured or otherwise provided as a roll. Other sheets of material may include fibrous mats.

The elements may be present in the polymer at a given volume. For example, the elements may be present in the range of 2% to 75% by volume of the polishing pad, including all values and increments therein. The elements may be relatively evenly distributed within the polishing pad itself, i.e., for a given portion of a polishing pad, substantially the same volume of elements may be present. In addition, the elements may be positioned in layers throughout the volume of the polishing pad, such that a layer of the polymer may be present and then a layer of elements may be present. It is also contemplated that the elements may be positioned in certain geometries around the polishing pad. For example, the elements may be positioned as a spiral, in concentric rings, or in a diamond or similar intersecting pattern.

The polishing pad may also include a plurality of pores or voids, herein after referred to as "voids". The voids may be formed herein without the use of any external additive having a preformed and structured void volume. The pores or voids may define a space of 0.1 $\mu m^3$ to 1,000,000 $\mu m^3$, including all values and increments therein, such as 100 $\mu m^3$ to 1,000,000 $\mu m^3$. The voids may be formed by physical or chemical interactions within the polymer. For example, the ability of the polymer to wet the individual elements may influence the creation of voids, i.e., when the polymer poorly wets the individual elements, voids may be created around the individual elements or when the polymer fully wets the individual elements, voids may be substantially reduced and/or eliminated.

Expanding upon this concept, it may be appreciated that one may select a given polymer resin that provides a particular contact angle with the fiber surface, such that when the liquid resin cures within the fiber network, a desired void size may be created. It is contemplated that contact angles as between a liquid resin (prior to cure) and the surface of a selected fiber may be adjusted such that a hydrophilic surface is associated with a hydrophobic resin, so that the contact angle is relatively high (i.e. greater than 90 degrees). It may also be appreciated that one may utilize a hydrophobic surface in combination with a hydrophilic resin. Furthermore, one may use resin/fiber combination that may be intermediate in their hydrophobicity or hydrophilic character, so that again, upon cure, a desired void volume may be produced.

Figure 2:
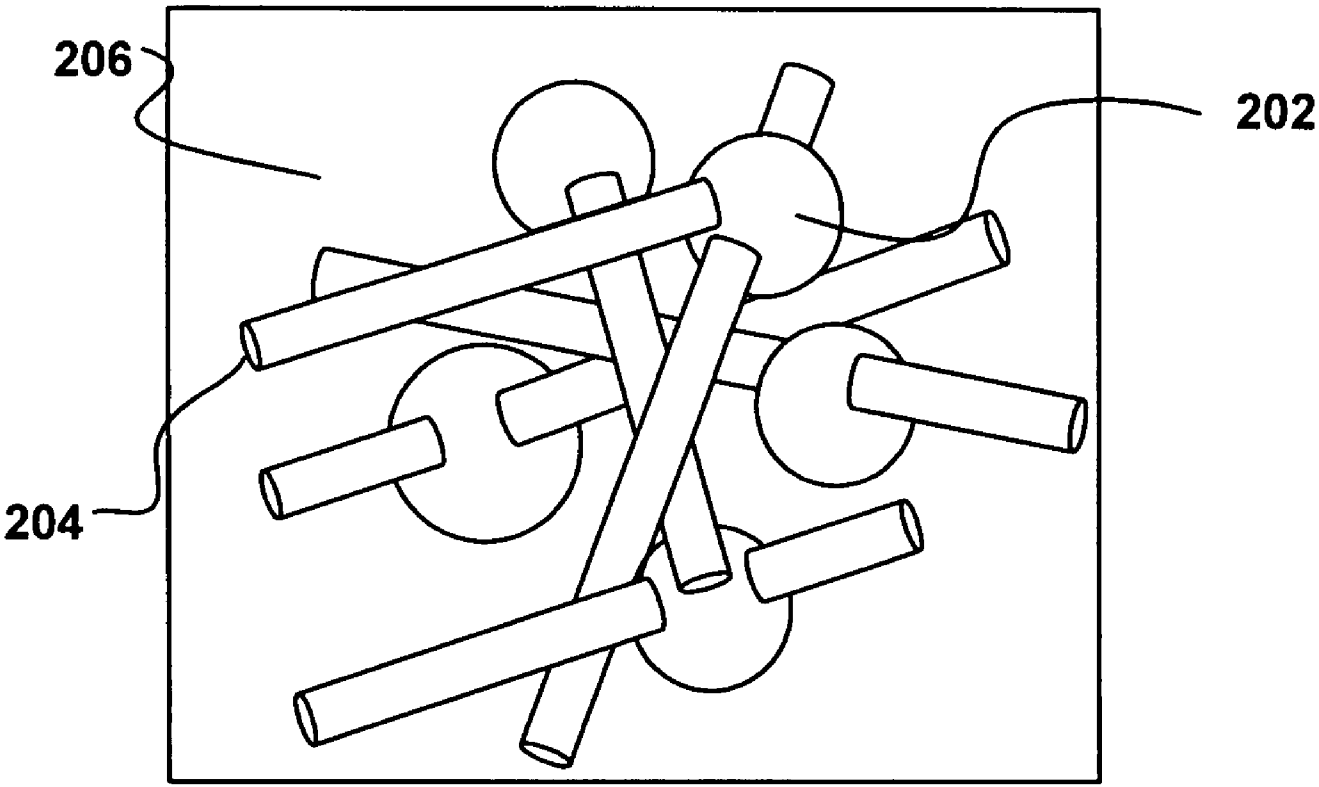
FIG. 2 is another example of voids in a polymer matrix.

In one example, illustrated in FIG. 1, the pores 102 may not be connected with the network of elements 104 in the polymer matrix 106 (i.e. the volume occupied by the polymer). In another example, illustrated in FIG. 2, the pores 202 may be connected with the network of elements 204 in the polymer matrix 206. As seen in FIG. 2, a void may surround all or a portion of one or more elements. As shown, a portion of the network of elements 204 may be within at least a portion of the pores/voids 202. Stated another way, at least a portion of the pores/voids 202 each may have a volume which volume may contain at least a portion of the network of elements 104.

In another example, the voids may be formed by incorporating an additive within the elements or coating the elements with an additive that may volatilize and form a gas and therefore, a given void size and distribution. The additive may therefore provide voids either upon a chemical or thermal reaction that may release gas or cause expansion due to exposure to heat. Those of skill in the art will appreciate that one may therefore use a blowing agent which may be understood as a chemical component that, upon exposure to a given environmental condition (e.g. heat), produces a gas. In addition, the voids may be created by utilizing hollow fibers. In one example, the fibers may extend or release a gas upon the addition of heat. Furthermore, the voids may be created upon activation by a given energy source, such as lasers, UV, irradiation, etc.

Figure 3:
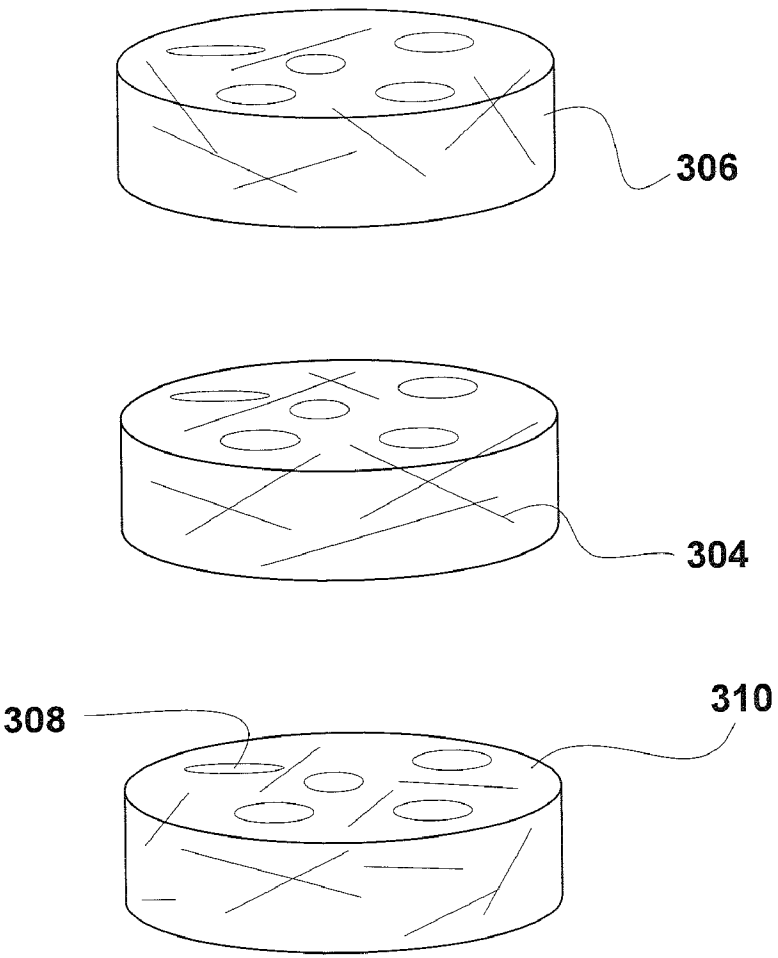
FIG. 3 is an example of indentations in a polymer matrix stack for forming voids.

In a further example, illustrated in FIG. 3 the voids may be created by stacking layers of the polymer matrix 306 including a number of elements 304, wherein the polymer matrix 306 layers may include indentations 308 in the surface 310. The indented surfaces 310 may form the voids when the layers have been stacked. In an addition example, the polymer matrix may be cracked to form voids or a laser, etching or embossing may be used to form voids.

The voids may form a void volume within the polymer matrix, such that a given percentage of the polymer matrix by volume defines voids. In one example, the void volume may be in the range of 5% to 25% of a given volume of the polishing pad, including all values and increments therein. In another example, the void volume may be in the range of 10% to 75% of a given volume of the polishing pad, including all values and increments therein.

The voids may be relatively evenly distributed within the polishing pad itself, i.e., for a given portion of a polishing pad, substantially the same volume of voids may be present. In addition, the voids may be positioned in layers throughout the volume of the polishing pad, such that a layer of voids may be present and then a layer of the polymer matrix may be present. It is also contemplated that the voids may be positioned in certain geometries around the polishing pad. For example, the voids may be positioned as a spiral, in concentric rings, or in a diamond or similar intersecting pattern.

The polishing pad may be formed by preconditioning the polymer or pre-polymer, any curatives or additives and the elements. The prepolymer may then be combined with the curatives or additional additives and dispensed over the elements in a mold. The mold may be held at a set temperature or a temperature profile until polymerization proceeds and the polishing pad may be obtained. The reaction of the curative with the prepolymer may result in relatively higher molecular weight polymer which may be understood as curing or (if crosslinking occurs) gellation. The polishing pad may then be removed and post-cured in an oven for a given time and temperature.

Once the polishing pad is cured, the surface of the polishing pad may be found or buffed to remove any surface layers. Any grooves, indents or perforations may be added. The polishing pad may also be laminated to a subpad using an adhesive, such as a pressure sensitive adhesive.

Expanding upon the above, the prepolymer may be reactive, and itself may have a number average molecular weight of less than or equal to 10,000. For example, the prepolymer may include reactive end-groups, which may then be joined together by a curative, where a curative may be understood as a co-reactant for the reactive prepolymer. For example, the prepolymer may include a reactive organic base end group, and may specifically include an amino (—$NH_2$) or hydroxyl (—OH) terminated polyether, and the curative may include an isocyanate (—NCO) compound containing two or more isocyanate groups. The reactive prepolymer may also include hydroxyl terminated polyesters, or hydroxyl terminated polydienes, such as a hydroxyl terminated polydiene, such as hydroxyl terminated polybutadiene. Furthermore, as may be appreciated, when the combination of the curative (diioscyanate compound) and reactive prepolymer is adjusted such that some residual level of unreacted isocyanate remains (e.g. less than or equal to 5.0 weight percent, or 0.1-5.0 weight percent) one may then introduce a selected amount of water, which may then react with the isocyanate to form carbon dioxide, which as noted, may be relied upon to provide void formation within the pad.

In that regard, the water may be understood as a blowing agent when combined with a isocyanate, which is therefore any component that provides a source of gas which may used to provide voids. Other blowing agents may include any organic compound that either rearranges and/or itself has a vapor pressure sufficient to convert into a gas form, and again, provides voids within the pad. Typically, one may use a component that upon exposure to heat, either rearranges or converts to a gas. For example, one may utilize AIBN or relatively low molecular weight freon or halogenated freon-type compounds. For example, one may use chlorotrifluromethane (CTFM). Blowing agents may therefore include compressed gases that expand when pressure is released, soluble solids that leave pores when leached out, liquids that develop cells when they change to gases, and chemical agents that decompose or react under the influence of heat to form a gas. Chemical blowing agents range from simple salts such as ammonium or sodium bicarbonate to complex nitrogen releasing agents (AIBN).

By way of a more specific example, one may combine a hydroxyl terminated polyether with a diisocyanate terminated compound and react to form a polyurethane in the presence of a blowing agent (e.g. less than or equal to about 5.0% by weight of a blowing agent). The diisocyanate may include both aliphatic and/or aromatic type diisocyanate compounds. For example, the diisocyanate compound may include methylene bisphenyl diisocyanate (MDI) or toluene diisocyanate (2.4-TDI or 2-6-TDI). The polyether may include polyethylene oxide, polypropylene oxide, and/or polyethylene-polypropylene copolymer. Such polyether may have a molecular weight of equal to or less than about 10,000. In addition, one may include isocyanate compounds that have a functionality of greater than 2 to provoke some desired level of crosslinking.

The polyurethane formulations noted above may also include an extender, which may be understood as a relatively low molecular compound which may react with the reactive prepolymer and provide higher overall molecular weight. Typically, such extenders are those compounds such as relatively low molecular weight (less than or equal to 500) dihydroxy compounds and/or diamine compounds. Such dihydroxy compounds and/or diamine compounds may include the use of the dihydroxy and/or diamine functionality on an aliphatic and/or aromatic moiety.

Accordingly, it may now be appreciated that the composition for forming the polishing pad herein may include one of a polymer (of relatively high molecular weight, e.g. a number average molecular weight of over 10,000) or one of a reactive prepolymer (as noted, a number average molecular weight of less than or equal to 10,000). The polymer may therefore be one that is capable of being heated and which will flow and then at lower temperature, solidify to provide for a polishing pad product. The reactive prepolymer may therefore be one that may be cured (in the presence of a co-reactant) to relatively higher molecular weights (e.g. number average molecular weights of over 10,000). In addition, it is contemplated herein that one may utilize a polymer as noted above, in combination with a reactive prepolymer/curative, as again noted above.

It may now be appreciated, in the event that fibers are utilized herein as the network of elements, and such fibers have a particular level of water/moisture associated therewith (e.g. 0.1-5.0% by weight), the water in the presence of an isocyanate, may give rise to the generation of gas and the formation of voids on the fibers at the interface where the components meet. That is, the diisocyanate reactant which is primarily targeted for reaction with the reactive prepolymer, may come in contact with residual water, such as an atmospheric level of moisture, on or within the fibers, and react to form carbon dioxide gas, thereby giving rise to a void which is directly associated with the fiber (e.g., a void that surrounds all or a portion of the fiber). Stated another way, such results in at least a portion of the network is within such voids, or at least a portion of such voids contain a portion of the network of elements. It may also be further appreciated that fabric material that contains residual water will be prone to provide a higher relative level of void content.

As the polishing pad wears away during planarization or polishing the elements and/or voids may be exposed. Where the elements and/or voids may be soluble upon contact with the polishing solution, the elements and/or voids may provide voids of varying geometries.

It may further be appreciated that such voids may be particularly useful when combined with a network of elements which is soluble in a slurry used with the pad when the pad is used for polishing, such as an aqueous slurry. When such a soluble network of elements is used (such as soluble fibers), and the network of elements dissolves, the space occupied by the network of elements may now be occupied by the slurry. Here, by virtue of the voids being formed around the fibers, once the fiber dissolves, the volume of space which may now be occupied by the slurry increases by the increased volume of the voids. Thus, such pads will be able to retain relatively higher amounts of the slurry.

With respect to process conditions, it has been found that void content may be varied particularly by the water content provided with the polymer, surfactant level, by preheating the network of elements and by changing the gap height within the mold.

FIG. 4 shows that with an increase in the water content in the polymer (urethane) from 0.5% to 1%, along with an increase in the surfactant level from 0.1% to 0.2%, the void content of the pad increases and the pad density decreases.

FIG. 5 shows that when the network of elements (fabric) is pre-heated, the void content decreases and the pad density increases as compared to the void content shown in FIG. 4.

FIG. 6 shows that when the gap height of the mold is changed from 130 mils (0.130 inches) to 100 mils (0.100 inches), voids can be developed, and the void content may be made to increase for a network of elements (a fabric) in conjunction with the formed polymer, in the absence of a gas. That is, voids can be formed due to what may be understood as primarily mechanical means, such as the elastic recovery of the fabric from a given compression within the polymer, as explained more fully below.

First, it is worth noting that reference to gap height in FIG. 6 is reference to the height of the enclosed volume of the mold. In this particular example, the mold also had about a 34 inch width and a 34 inch length. However, any dimension of mold is contemplated herein that would be suitable for production of a polishing pad. Furthermore, the mold may be such that it also includes relatively small openings in communication with outside air, so that the mold may be vented and/or air may be drawn into the mold to form the voids. That is, with respect to the data shown in FIG. 6, the fabric employed had a specific thickness of about 130 mils. Accordingly, when placed in the mold that was provided with a gap height of about 130 mils, the fabric will not undergo significant compression. Alternatively, when a mold gap height of 100 mils is applied to this same 130 mil thick fabric, it can be appreciated that the fabric will then be compressed. Then, upon release of such compression, the fabric may rebound (e.g. elastic recovery) which may then operate to draw air into the mold and into the polymer, thereby resulting in void formation. The drawing in of air or any other gas may be desired, may be the result of the feature that the formed polymer may adhere to the fabric, and when the fabric rebounds, a region of reduced pressure may be locally formed, thereby drawing in the available gas through a mold vent, with ensuing void development. As can therefore be seen, at a gap height of 130 mils, the void content is relatively low (8.7%) and at a gap height of 100 mils the void content is increased to relatively higher values (29.57%).

It may therefore be appreciated that with respect to applying a force to a selected fabric, one may apply such force to at least one of the physical dimensions of the fabric, such as either the fabric length, width and/or thickness. Upon application of a force to one of such indicated dimensions, the fabric may then change one of the dimensions of length, width or thickness. When the force is removed at least one of said length, width or thickness dimension then again changes in value (e.g. the fabric seeks to return to its original dimensions) which then leads to the formation of one or a plurality of voids. For example, when the force is removed the network of elements, which have been compressed, may undergo recovery, and as noted above, this may then lead to drawing in of some gas and void formation.

Accordingly, while it may be convenient to compress and reduce the fabric thickness in a selected mold, followed by removal of the force and void formation, it should be understood that one may even enlarge the dimensions of length and/or width and/or thickness of the fabric with a similar result. In addition, one may reduce or enlarge all of the dimensions (length, width and thickness) if desired. Accordingly, in the broad context of the present disclosure, one may utilize a network of elements (e.g. a fabric), which fabric, when undergoing a change in dimension (either increasing or decreasing one of the length, width or thickness), will cause one or a plurality of voids to form within the polishing pad volume. In such regard, it may be appreciated then when, e.g., enlarging a particular dimension of length, width or thickness of the network of elements, and then allowing for recovery, one may form voids as the network of elements may be understood to then shrink in one or more dimensions, along with any associated polymer or reactive prepolymer, thereby resulting in void formation.

Furthermore, it may be appreciated that for a given fabric, one may now select such fabric depending upon its elastic characteristics (e.g. the elastic response) which elastic response may be employed for void formation. In the context of the present invention, it is contemplated that the fabric may, for a given applied force and corresponding dimensional change, have an elastic recovery of 1.0%-99%, including all values and increments therein. The fabric may also have an elastic elongation of up to and including 200%, along with the indicated elastic recovery characteristics. As may be appreciated, relatively greater amount of elastic recovery will lead to relatively higher levels of gas to be drawn into the mold, thereby providing relatively higher amounts of void formation. Along such lines, it should be appreciated that a fabric having an elastic recovery of 1% to 10% may be sufficient for development of voids for a given CMP type application.

Figure 7:
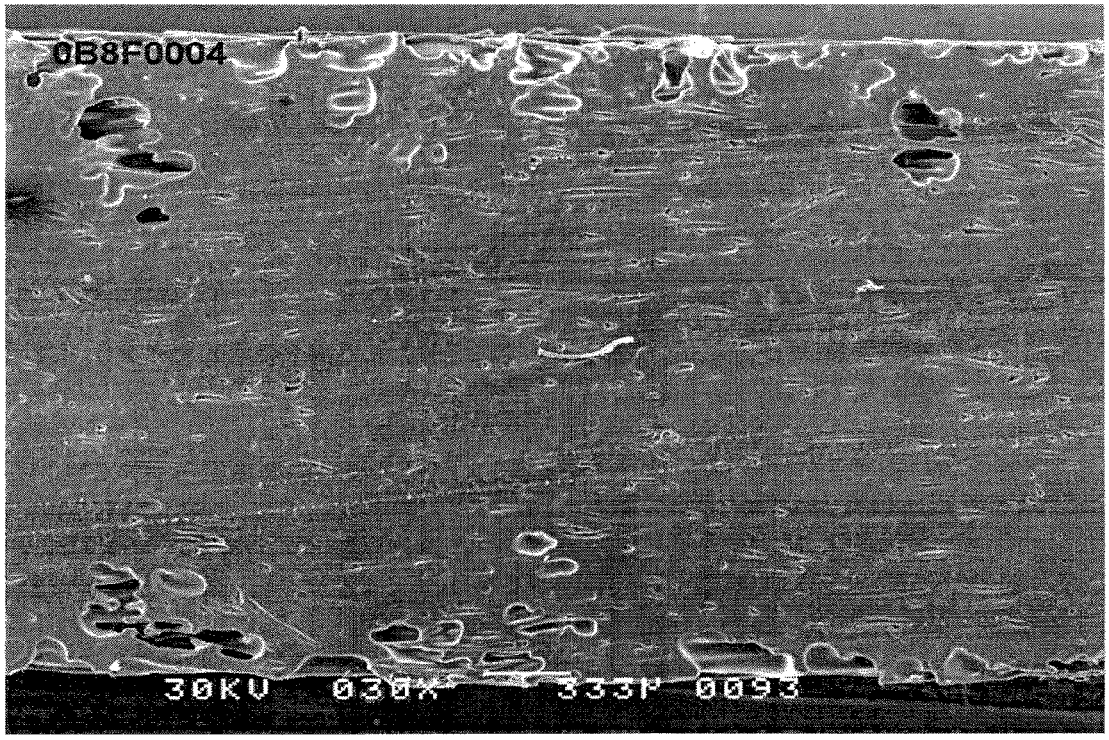
FIG. 7 is a scanning electron micrograph of a pad cross-section showing void content for a mold gap height of 40 mils.
Figure 8:
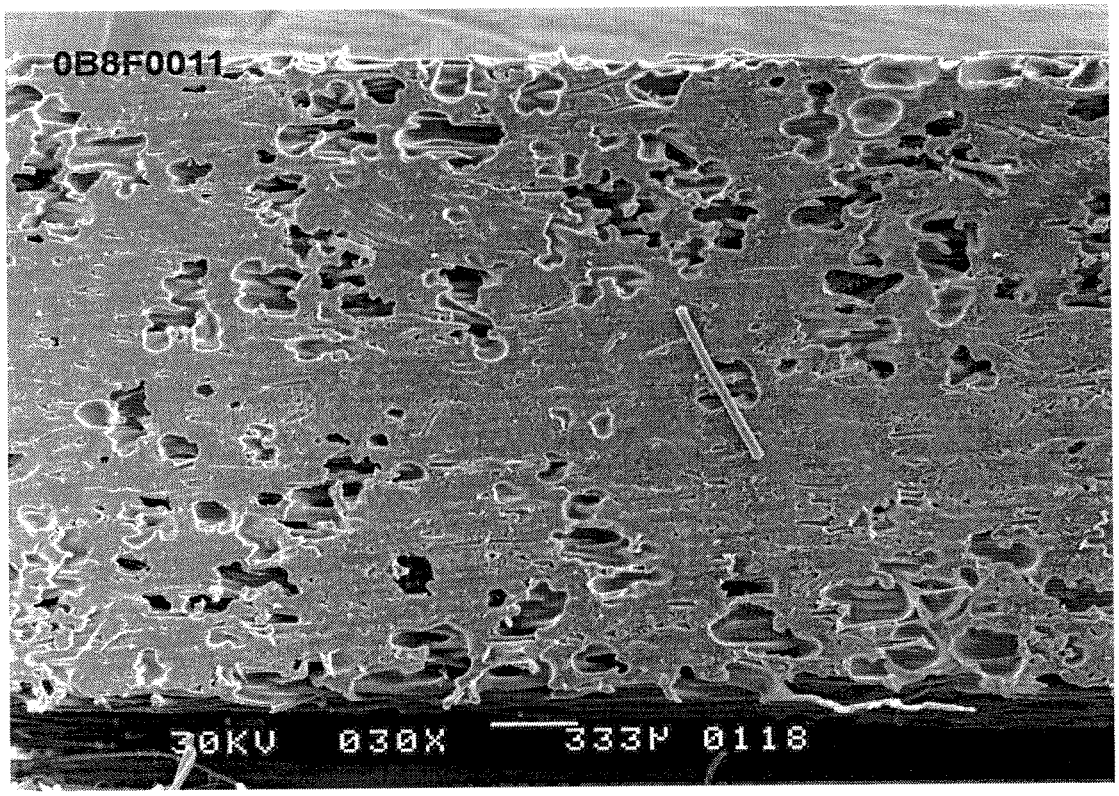
FIG. 8 is a scanning electron micrograph of a pad cross-section showing void content for a mold gap height of 10 mils.

The actual difference in the void content due to the use of what was described above as mechanical means, is now shown in FIG. 7 and FIG. 8, respectively. From these scanning electron microscopy photos, each taken at about the same magnification, it can be seen that one may utilize the elastic recovery of the fabric to draw gas into the formed polymer, thereby creating voids within a chemical mechanical polishing pad. Such method of forming voids through recovery of the fabric to an applied force, may therefore be used alone and/or in combination with the use of a volatilizing gas (e.g. from an additive that forms a gas due to heat) as noted above. That is, the volatizing gas and drawn-in gas may be the same (e.g., they may both be air), or they may be different (e.g., air versus nitrogen).

The foregoing description of several methods and embodiments has been presented for purposes of illustration. It is not intended to be exhaustive and obviously many modifications and variations are possible in light of the above teaching.

What is claimed is:

1. A method of forming a chemical-mechanical planarization polishing pad comprising:

providing a composition, the composition including a network of elements in the form of a fabric and at least one of a polymer or a reactive prepolymer wherein said polymer or prepolymer is dispensed over said elements in a mold;

introducing a first gas to the composition;

using the gas to produce a plurality of voids in the composition wherein said voids define a space of 0.1 $\mu m^3$ to 1,000,000 $\mu m^3$; and forming a polishing pad including said network of elements in the form of said fabric dispersed within said polymer or said reactive prepolymer including said plurality of voids formed in the pad, wherein at least a portion of said network of elements is connected to at least a portion of said voids and wherein said network of elements comprises a plurality of soluble fibers wherein said fibers have a length in the range of 0.1 mm to 500 mm and a diameter in the range of 0.1 μm to 100 μm and are present at a level of 2% to 75% by volume of the polishing.

2. The method of claim 1 wherein the step of introducing a first gas to the composition is accomplished by a component of the composition which volatilizes to provide the gas.

3. The method of claim 2 wherein the component volatilizes as a result of at least one of a chemical reaction, thermal reaction and exposure to heat.

4. The method of claim 2 wherein the component comprises a blowing agent.

5. The method of claim 2 wherein the component is provided with the network of elements.

6. The method of claim 1 wherein the step of introducing a first gas to the composition is accomplished by exposing a blowing agent within the composition to a condition which generates the gas.

7. The method of claim 6 wherein the blowing agent is provided with the network of elements.

8. The method of claim 1 wherein the composition is provided by placing the network of elements into a mold and thereafter introducing at least one of the polymer and the reactive prepolymer into the mold.

9. The method of claim 1 wherein the first gas is introduced to the composition during a gelation of the composition in a mold.

10. The method of claim 1 wherein the network of elements is interconnecting.

11. The method of claim 1 wherein the network of elements is provided in a layer within the pad.

12. The method of claim 1 wherein at least a portion of the network of elements is hydrophilic.

13. The method of claim 1 wherein the fibers are provided in a form of a sheet.

14. The method of claim 1, wherein said network of elements has a dimension of length, width and/or thickness, and one of said length, width or thickness dimension is changed by the application of a force in the presence of one of said polymer or reactive prepolymer, wherein said force is removed and at least one of said length, width and/or thickness changes in value to form one or a plurality of voids.

15. The method of claim 1 wherein said first gas comprise air.

16. A method of forming a chemical-mechanical planarization polishing pad comprising:

providing a composition, the composition including a network of elements and at least one of a polymer and a reactive prepolymer, wherein said network of elements comprises a plurality of fibers in the form of a fabric, wherein said network of element has a dimension of length, width and/or thickness and said fabric exhibits an elastic recovery of 1.0 to 99%;

changing one of said length, width or thickness dimension by the application of a force in the presence of one of said polymer or reactive prepolymer;

removing said force, wherein said fabric recovers and said at least one of said length, width and/or thickness changes in value to form one or a plurality of voids; and forming a polishing pad including said network of elements in the form of said fabric dispersed within said polymer or said reactive prepolymer including said plurality of voids formed in the pad, wherein at least a portion of a said network of elements is connected to at least a portion of said voids.

* * * * *